US005727628A

United States Patent [19]

Patzner

[11] Patent Number: 5,727,628

[45] Date of Patent: Mar. 17, 1998

[54] METHOD AND APPARATUS FOR CLEANING WELLS WITH ULTRASONICS

[76] Inventor: Norbert Patzner, Waldstrasse 14, 97980 Bad-Mergentheim, Germany

[21] Appl. No.: 621,815

[22] Filed: Mar. 22, 1996

[30] Foreign Application Priority Data

Mar. 24, 1995 [DE] Germany ..... 195 10 421.8
Feb. 1, 1996 [EP] European Pat. Off. ..... 96101406

[51] Int. Cl.[6] ..... E21B 37/08

[52] U.S. Cl. ..... 166/249; 166/68.5; 166/177.2; 166/311

[58] Field of Search ..... 166/177.1, 177.2, 166/177.6, 68.5, 249, 311, 369

[56] References Cited

U.S. PATENT DOCUMENTS

| | | | |
|---|---|---|---|
| 2,700,422 | 1/1955 | Bodne, Jr. | 166/177.1 X |
| 2,705,460 | 4/1955 | Burdick | 166/177.2 X |
| 2,816,612 | 12/1957 | Hutchison et al. | 166/177.6 |
| 3,578,081 | 5/1971 | Bodine | 166/249 |
| 3,970,146 | 7/1976 | Keenan, Jr. | 166/249 |
| 4,280,557 | 7/1981 | Bodine | 166/177.2 |
| 4,469,175 | 9/1984 | Massa | 166/249 |
| 4,509,593 | 4/1985 | Traver et al. | 166/249 X |
| 5,184,678 | 2/1993 | Pechkov et al. | 166/249 |
| 5,458,860 | 10/1995 | Morris et al. | 166/311 X |
| 5,595,243 | 1/1997 | Maki, Jr. et al. | 166/177.2 |

FOREIGN PATENT DOCUMENTS 4037899 6/1992 Germany .

*Primary Examiner*—George A. Suchfield
*Attorney, Agent, or Firm*—W. G. Fasse; W. F. Fasse

[57] ABSTRACT

An apparatus for cleaning wells using ultrasonic waves includes a plurality of magnetostrictive ultrasonic transducers and a water pump. The ultrasonic transducers are arranged in one or more planes and carried by an adjustment mechanism to allow the cleaning unit to be adjusted to different well diameters, while ensuring that each transducer remains properly oriented to direct the ultrasonic waves perpendicularly at the well casing from an optimum spacing distance. Any desired number of ultrasonic transducer modules can be connected together in the axial direction to ultrasonically clean a portion of the well having a desired axial length in each operating step. The ultrasonic transducers are operated with a power density of 8 to 12 W/cm$^2$ of ultrasonic emitting surface area, at a frequency in the range of 18 to 25 kHz and preferably 20 kHz. In a first operating step, the ultrasonic transducers ultrasonically treat a first section of the well. In a second operating step of a first embodiment, the cleaning unit remains in the same location and the pump sucks out the dirty water from the ultrasonically treated first section. In a second operating step of another embodiment, the apparatus is first lowered by one working step distance and then the pump is operated to suck out the dirty water.

25 Claims, 8 Drawing Sheets

METHOD AND APPARATUS FOR CLEANING WELLS WITH ULTRASONICS

FIELD OF THE INVENTION

The invention relates to a method and an apparatus for cleaning wells using a cleaning unit that includes a water pump and an ultrasonic transducer.

BACKGROUND INFORMATION

In general, wells of the type of interest for the present invention are water wells providing potable water for consumption and/or water for industrial use. Such wells typically comprise a well shaft or bore that is lined with a well sidewall or casing that forms a filter pipe. Such a well casing has slit-shaped openings therethrough, so that water can flow from the surrounding water-bearing ground formations into the well bore. Typically, a gravel layer is located immediately outside the well casing, and undisturbed solid ground surrounds the gravel layer. Over time, the water production rate of such a well diminishes, because various types of contaminants become deposited both in the gravel layer and in the slit-shaped openings of the well casing. Such contaminants or deposits hinder or eventually totally block the flow of water into the well bore.

German Patent Laying-Open Document 4,037,899 (Kopke) describes the various types of contaminants that can block the water flow, and the problems caused thereby. German Publication 4,037,899 also describes various generally known mechanical and/or chemical methods that have been used in the art to try to clean the slit-shaped openings of the well casing and the gravel layer directly outside the well casing.

German Publication 4,037,899 further describes a method and apparatus for cleaning a well using a device that includes a suction and pressure pump (2), and a pressure pump (18), and may additionally include an ultrasonic transducer (10) arranged within a suction chamber (6) of the pump (2). To carry out the cleaning, the pressure pump (18) directs jets of water radially outwardly through a ring-shaped jet channel (15) to hydraulically flush the slit-shaped openings of the well casing with strong jets of water. The suction pump (2) creates suction in the chamber (6) to suck out contaminants with a strong water flow from the gravel layer into the well. The ultrasonic transducer (10) may optionally be arranged in the suction chamber (6) to help loosen the contaminants from the well casing and the surrounding gravel layer.

The apparatus and method according to German Publication 4,037,899 have failed to achieve satisfactory cleaning results, because the prior art does not teach how the ultrasonic waves should be most efficiently produced, and how one or more ultrasonic transducers should be operated, arranged and oriented to achieve a strong, primary ultrasonic cleaning effect.

OBJECTS OF THE INVENTION

In view of the above it is the aim of the invention to achieve the following objects singly or in combination:

- to provide a method and apparatus for cleaning wells using ultrasonics, that overcome the prior art problems and short-comings, and achieve a highly effective cleaning while also being particularly ecologically and environmentally advantageous;
- to suggest a particular type of ultrasonic transducer to be used most effectively in a well cleaning method and apparatus;

- to provide particular operating parameters, and a particular orientation and arrangement of a plurality of ultrasonic transducers to achieve an improved cleaning effect by making use of longitudinal oscillations, especially at resonant frequencies, with the resultant ultrasonic waves directed substantially perpendicularly at the well casing;
- to provide a method and apparatus of the above type, especially wherein the cleaning effect is predominantly or even totally achieved by ultrasonics, i.e. without chemical solvents, brushes or water jets, and wherein a water pump is used only for removing contaminant-containing dirty water after the ultrasonic cleaning step has been carried out; and
- to provide a particular construction of a well cleaning apparatus that ensures a proper placement and orientation of the ultrasonic transducers throughout a cleaning procedure, that is simpler in construction than prior art apparatus, and that can be easily adapted, adjusted, or reconfigured as needed to suit various well cleaning situations.

SUMMARY OF THE INVENTION

The above objects have been achieved in a method and apparatus for cleaning wells according to the invention, wherein the ultrasonic waves are magnetostrictively produced. In other words, the apparatus according to the invention uses magnetostrictive elements as ultrasonic generating transducers. The operation of the magnetostrictive transducer elements requires a sufficiently strong power source and appropriate control arrangements. The ultrasonic transducer functions using oscillations or vibrations in the form of longitudinal oscillations, which are radiated radially outwardly. Furthermore in this context, resonant frequencies are used. In this manner, a relatively strong beam of ultrasonic waves can be efficiently produced and directed. Preferably, the magnetostrictive element that undergoes the lengthwise oscillations comprises high alloy nickel sheets.

According to another particular aspect of the invention, the ultrasonic transducers are operated with a power density in the range from 8 to 12 W/cm$^2$ of the ultrasonic emitting surface. Extensive experimental tests have shown that this particular range of power densities achieves a good cleaning effect while maintaining an economical operation, in consideration of typical well configurations including typical slit-shaped openings and in consideration of the materials that surround the well casing, such as a gravel fill including stones having a diameter of 4 mm as a particular example. The ultrasonic frequencies to be used according to the invention are preferably in the range from about 18 to about 25 kHz and most preferably about 20 kHz.

The apparatus according to the invention preferably arranges a plurality of ultrasonic transducers in such a manner that the ultrasonic waves are directed perpendicularly against the well casing. The ultrasonic transducers are held in one plane, or even several planes, by an adjustment mechanism that allows the diametrical spacing between the transducers in a given radial plane to be adjusted while maintaining the proper orientation of the transducers. Any desired number of modules carrying the transducers can be connected together in the axial direction to provide a desired number of transducers at a desired number of planes to meet cleaning requirements of a specific application. The apparatus includes a water pump to suck away the contaminant-laden dirty water once the contaminants have been ultrasonically loosened or removed from the well casing and the surrounding gravel layer.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
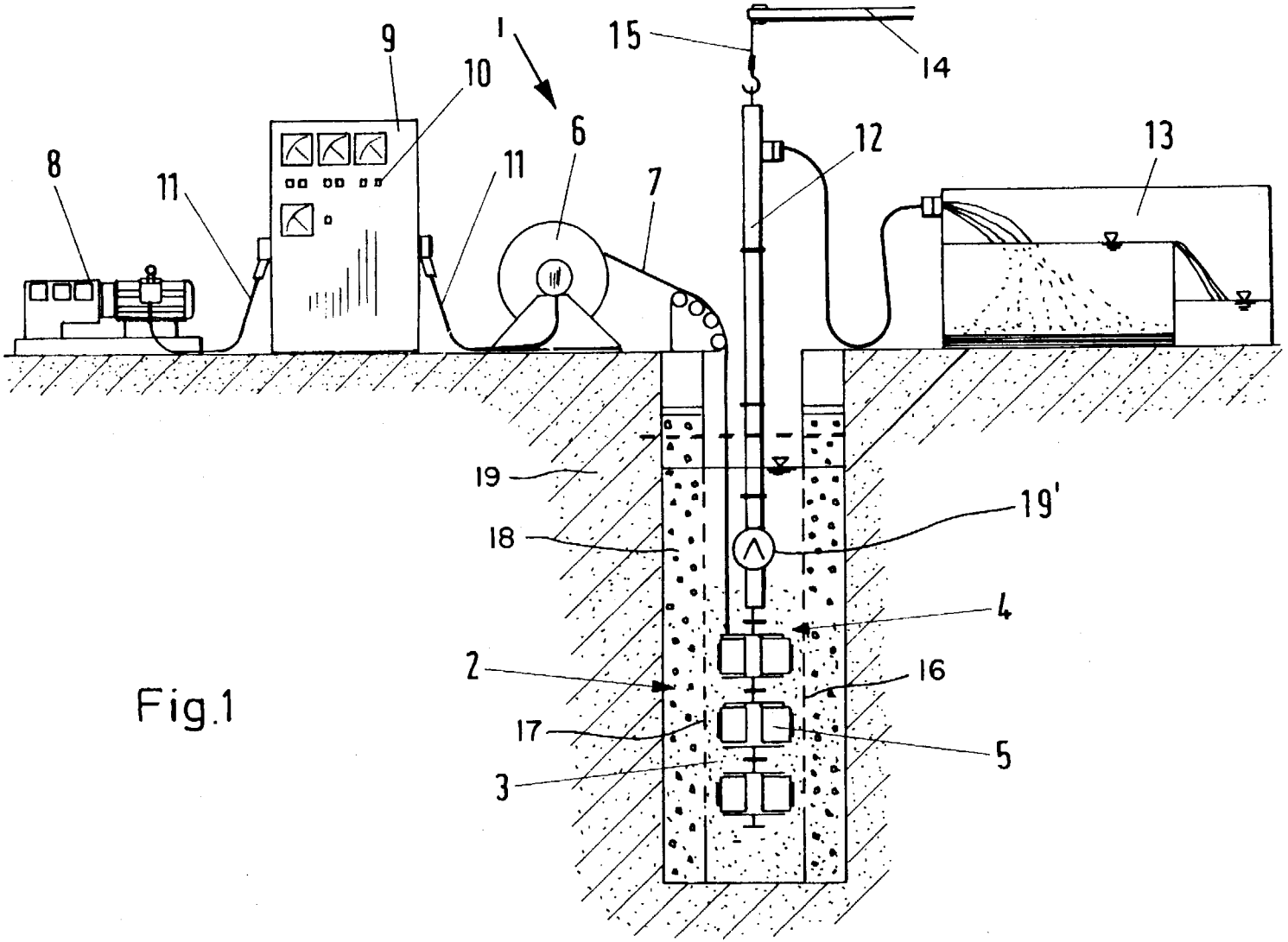
FIG. 1 is a schematic overview of various components of a system for cleaning a well using ultrasonics according to the invention.
Figure 2:
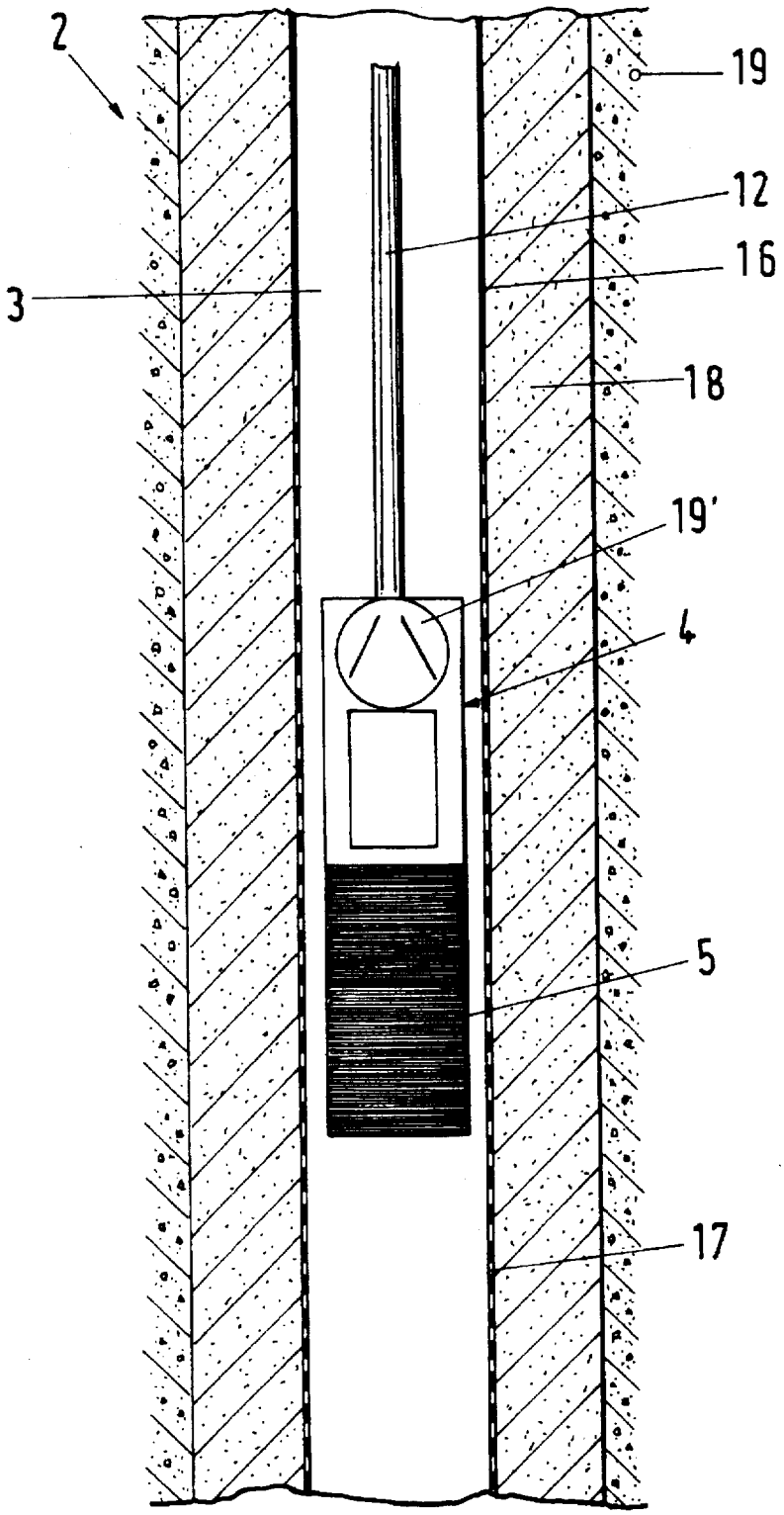
FIG. 2 is an enlarged detailed sectional view of an ultrasonic cleaning unit according to the invention arranged in a well.

FIG. 1 shows an overview of the components of an apparatus or system 1 for cleaning a well 2 that provides potable water for consumption or water for industrial use. The well 2 includes a well shaft or bore 3 that is bounded or lined with a well casing 16 having openings 17 therethrough at least at water-bearing levels of the surrounding ground formations. A layer of loose gravel 18 surrounds the well casing 16, and undisturbed solid ground 19, such as layers of soil and rock, surrounds the gravel layer 18. FIG. 2 shows the features of the well 2 in greater detail.

Referring to FIGS. 1 and 2, the cleaning system 1 comprises a cleaning unit 4 that is supported on the bottom end of a pole or rod 12 of pipe sections, whereby the cleaning unit can be lowered into the well bore 3 while additional pipe sections are connected together as needed. The pipe rod 12 hangs from a cable 15 that is lifted and lowered as needed by a lifting rig 14, in order to lower and then step-wise move the cleaning unit 4 to carry out a cleaning procedure, and to haul up the cleaning unit 4 after a cleaning procedure has been completed.

The cleaning unit 4 includes a water pump 19' connected to the bottom end of the pipe rod 12 and an ultrasonic generator unit 5 suitably connected below the pump 19'. Electrical power for driving the ultrasonic generator unit 5 is generated by a motor driven generator 8, is conducted through an electrical cable 11 to a switching and control unit 9 including control switches 10, and from there through an electrical cable 11 to an electric cable spool 6, from which an electric cable 7 connects to the cleaning unit 4, whereby cable 7 is payed out from the spool 6 as the cleaning unit 4 is lowered into the well. After the ultrasonic generator unit 5 loosens contaminants from the well casing 16, the openings 17 of the well casing, and the gravel layer 18 surrounding the well casing, the water pump 19' pumps away the contaminant-carrying dirty water through the pipe rod 12. The dirty water is discharged into a settling tank 13 where it is cleaned and further treated as desired.

Figure 3:
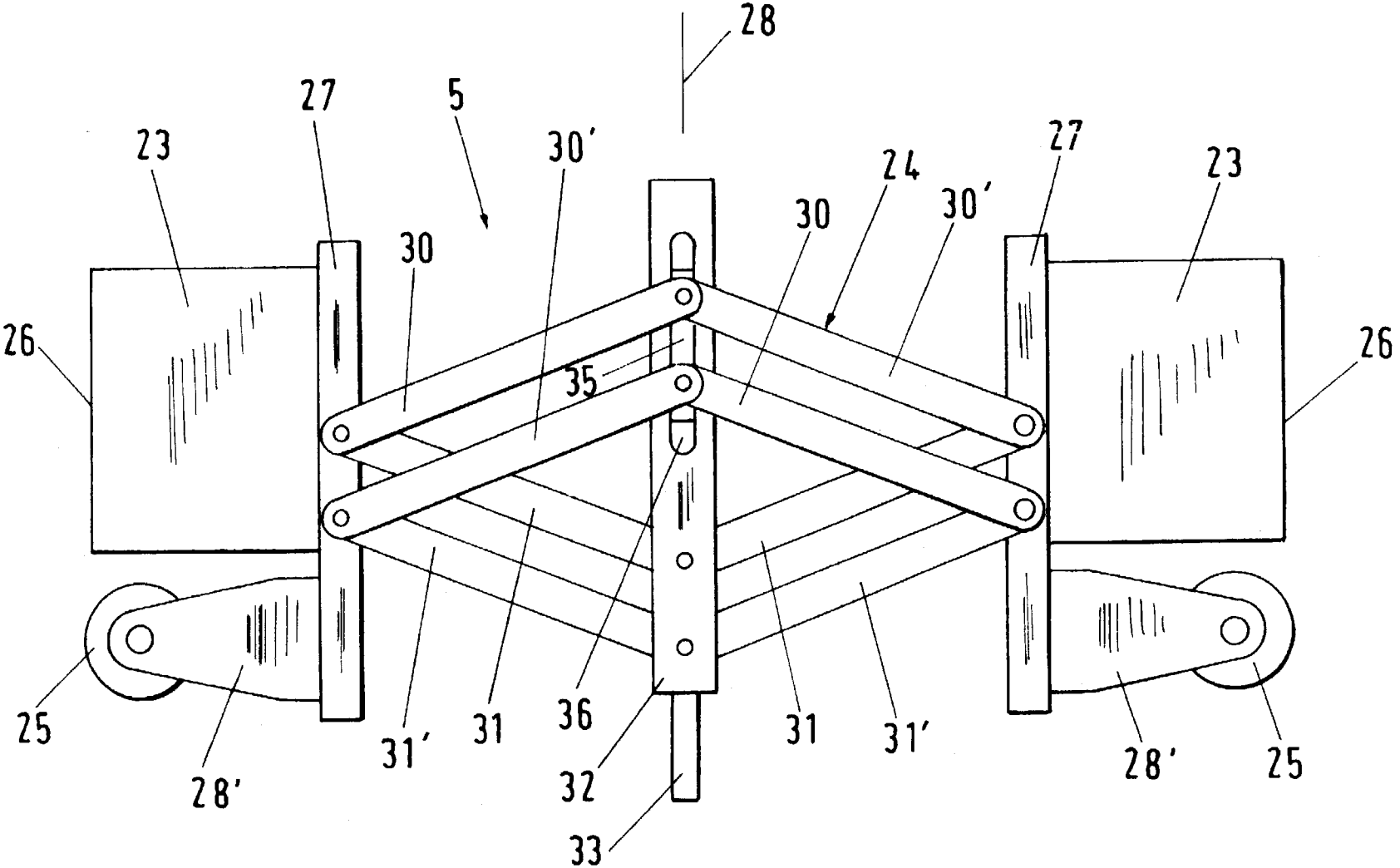
FIG. 3 is a further enlarged detailed side view showing a particular arrangement of ultrasonic transducers on an adjustment mechanism, forming an ultrasonic generator module in the ultrasonic cleaning unit according to the invention.
Figure 4:
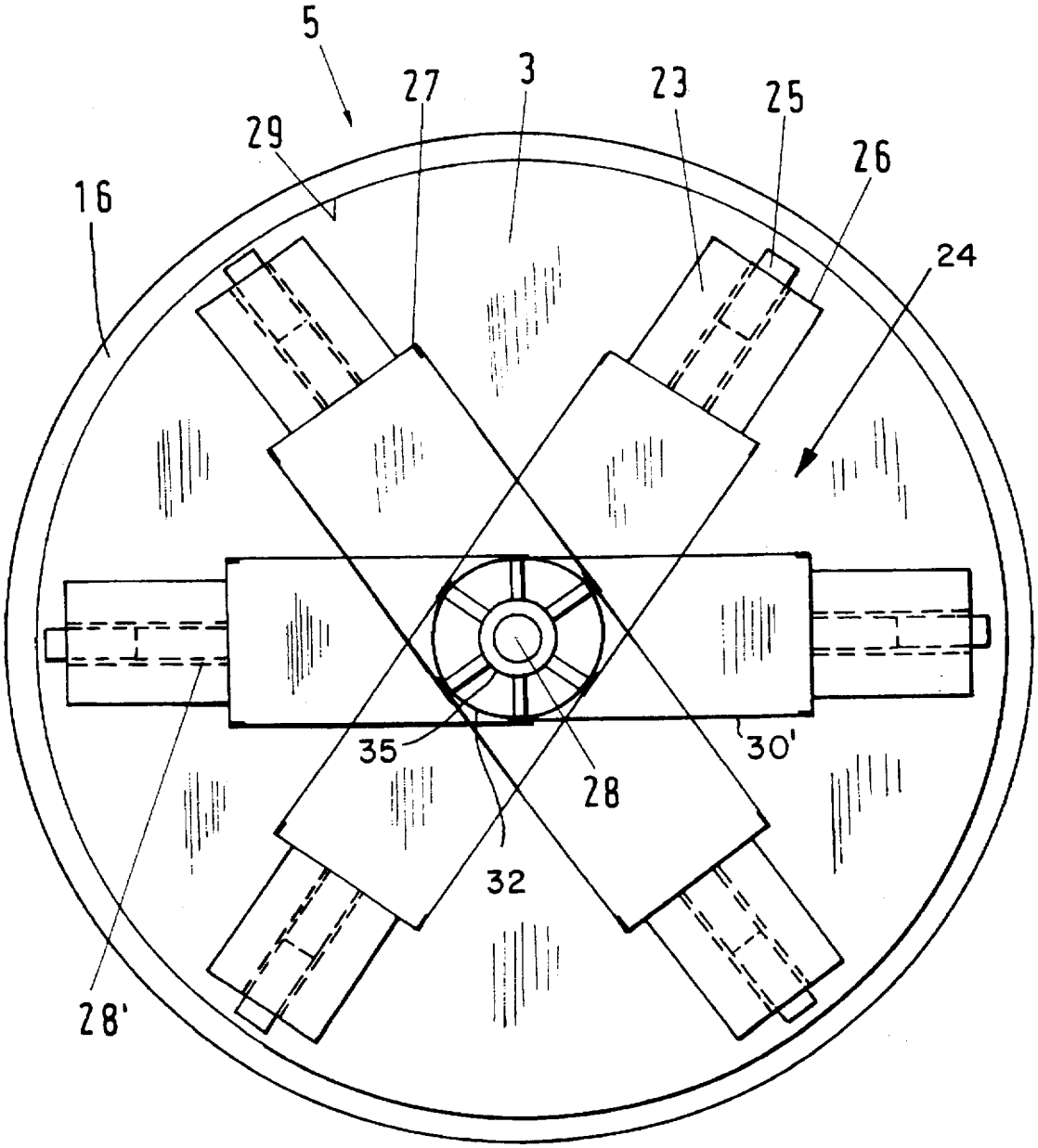
FIG. 4 is a top view of the ultrasonic transducer arrangement of FIG. 3.
Figure 5:
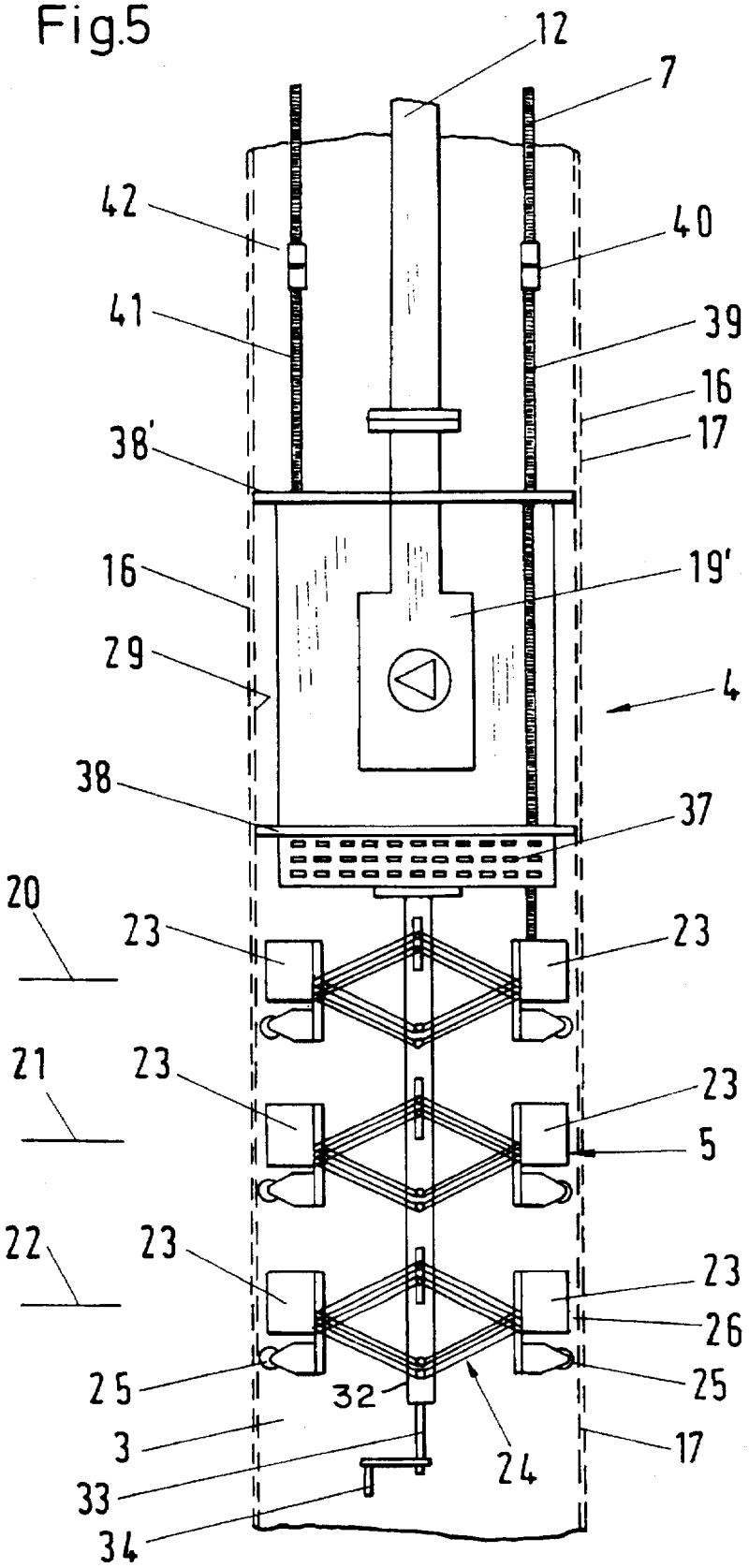
FIG. 5 is an enlarged view of the cleaning unit according to FIG. 2, including a plurality of the ultrasonic generator modules according to FIG. 3.

With reference to FIGS. 3, 4 and 5, the ultrasonic generator unit 5 preferably comprises at least two, and more preferably even more ultrasonic oscillator transducers 23 that may be arranged in several planes 20, 21, and 22 respectively. An adjustment mechanism is provided to adjust the positions of the several ultrasonic transducers 23 to the respective diameter of the well bore 3 being cleaned, and especially to the optimal spacing distance of the transducers 23 from the inner wall of the well casing 16. The invention further provides spacer members 25, preferably in the form of rollers, mounted on bearing brackets 28', to establish and maintain an exactly defined spacing distance between the respective ultrasonic emitting surface 26 of each respective ultrasonic transducer 23 and the inner wall 29 of the well casing 16 or the openings 17 located therein.

A first embodiment of an ultrasonic generator module including transducers 23 and a mounting and adjustment mechanism 24 is shown especially in FIGS. 3 and 4 taken together. Therein, the ultrasonic transducers 23 are respectively arranged on support members 27, which each have a U-shaped cross-section for example, and which respectively extend parallel to the lengthwise axis 28 of the well bore 3. The bearing brackets 28' carrying the rollers serving as spacer members 25 are also mounted on the support members 27. The ultrasonic transducers 23 comprise packets of high alloy nickel sheets that oscillate at a resonant frequency in the longitudinal direction. The ultrasonically emitting or radiating surfaces 26 of the transducers 23 are directed toward the well casing 16 in such a manner that the ultrasonic waves are directed across the shortest possible spacing distance toward and perpendicularly onto the inner surface 29 of the well casing 16 and also onto the openings 17 therein. The ultrasonic waves also penetrate the gravel layer 18 behind or outside of the openings 17 and thereby have a cleaning effect in the gravel layer 18 as well.

The adjustment mechanism 24 according to FIG. 3 allows the ultrasonic transducers 23 to be moved perpendicularly to the well axis 28 and to be optimally adjusted relative to the well casing 16. In the example embodiment according to FIG. 3, the adjustment mechanism 24 comprises respective parallel links or levers 30, 30' and 31, 31' that form a parallelogram linkage. The parallel links 30 and 30' form respective upper pairs of links, while the parallel links 31 and 31' form respective lower pairs of links. The respective upper links 30 and 30' are articulately connected to the respective lower links 31 and 31' to form V-shaped linkages with the vertex extending radially outwardly. The radially outer end of each pair of parallel links 30, 30' and 31, 31', i.e. at the vertex point of the V-shape, is pivotally or articulately connected to the respective support member 27 at two respective journal points.

The radially inner end of the lower parallel links 31 and 31', which extend downwardly and radially inwardly from the ultrasonic transducers 23, are articulately connected at two respective journal points to a tube or sleeve 32 that is arranged substantially in the center of the well and, for example coaxially with the well axis 28. The upper end of the sleeve 32 is rigidly connected to the bottom end of the dirty water pump 19'. A threaded rod 33 extends through the sleeve 32 in alignment with the well axis 28, i.e. coaxially with the sleeve 32. The upper end of the threaded rod 33 is rotatably held at the bottom end of the dirty water pump 19' so that the rod 33 is freely rotatable in both directions. The lower end of the threaded rod 33 extends downward below the sleeve 32 and may, for example, be fitted with a hand crank 34 (see e.g. FIG. 5). The threaded rod 33 fitted with the hand crank 34 allows the radial spacing of the ultrasonic transducers 23 to be adjusted manually to correspond to the respective diameter of the well casing 16 before the cleaning unit 4 is lowered into the well 2, as will be described next.

In order to allow the adjustment mechanism 24 to be adjusted, and thereby to allow the ultrasonic transducers 23 to be properly positioned, in the present example embodiment, the radially inner ends of the respective upper parallel links 30 and 30' are articulately connected to an adjustment nut or collar 35 that is arranged on the threaded rod 33. To achieve this, an elongated or slotted hole 36 sufficiently large to provide the desired adjustment range is provided in the sleeve 32, so that the articulate connection of the upper links 30 and 30' to the adjustment nut or collar 35 reaches through the elongated hole 36. With the above described arrangement, when the threaded rod 33 is rotated, the adjustment nut 35 correspondingly moves up or down along the threaded rod 33, which is held in its axial position relative to the sleeve 32. Thereby, the radially inner ends of the upper parallel links 30 and 30' are correspondingly moved up or down, which correspondingly adjusts the configuration of the V-shaped linkages 30, 30' and 31, 31' to correspondingly move the support members 27 and the transducers 23 mounted thereon radially inwardly or radially outwardly. The arrangement of parallel links 30, 30' and 31, 31' connected to the support members 27 at two points forms a parallelogram linkage that ensures that the support members 27 are always held vertically and parallel to one another, so that the ultrasonic transducers 23 are properly oriented relative to the well casing 16.

The example embodiment of FIG. 5 shows three of the adjustable ultrasonic generator modules described above mounted on a single supporting sleeve 32 and threaded rod 33 extending downwardly from the dirty water pump unit 19'. It should be understood that any desired number of ultrasonic generator modules can be connected together in this manner to provide a desired axial length of the ultrasonic generator unit 5. In the embodiment of FIG. 5, the dirty water pump 19' includes suction inlets 37 only at its lower end facing the ultrasonic transducers 23. Generally below the water pump 19', but above the suction inlets 37, a seal element 38 seals the housing of the pump 19' relative to the inner surface 29 of the well casing 16. A second similarly functioning seal 38' is arranged near the top of the pump housing, generally above the water pump 19'. Due to this arrangement of the suction inlets 37 and the seals 38 and 38', the dirty water pump 19' essentially only sucks liquid out of the part of the well bore 3 in which the ultrasonic transducers 23 are located. In other words, the pump 19' only sucks dirty water containing the contaminants that have been dislodged and broken up by the action of the ultrasonic transducers 23.

Power is supplied to the ultrasonic transducers 23 through electrical cables 39 which extend upward from the ultrasonic transducers 23 and through the pump chamber, and are then connected by a suitable water-tight electrical connector 40 to the power supply cable 7 that ultimately leads to the switching and control unit 9 and the generator 8 as described above. A further power supply cable 41 and an associated water-tight connector 42 are also provided according to FIG. 5, in order to supply electrical power to the dirty water pump 19'.

The manner of operation of the cleaning unit 4 according to FIG. 5 characteristically involves first ultrasonically irradiating or impinging upon a given region of the well bore 3 that is to be cleaned, and then, without moving the cleaning unit, sucking out the dirty water from the region that has just been cleaned. Thereafter, the entire cleaning unit 4 is lowered, i.e. shifted downward, by one unit distance or working step, whereupon the next successive region of the well bore 3 is ultrasonically cleaned.

Figure 6:
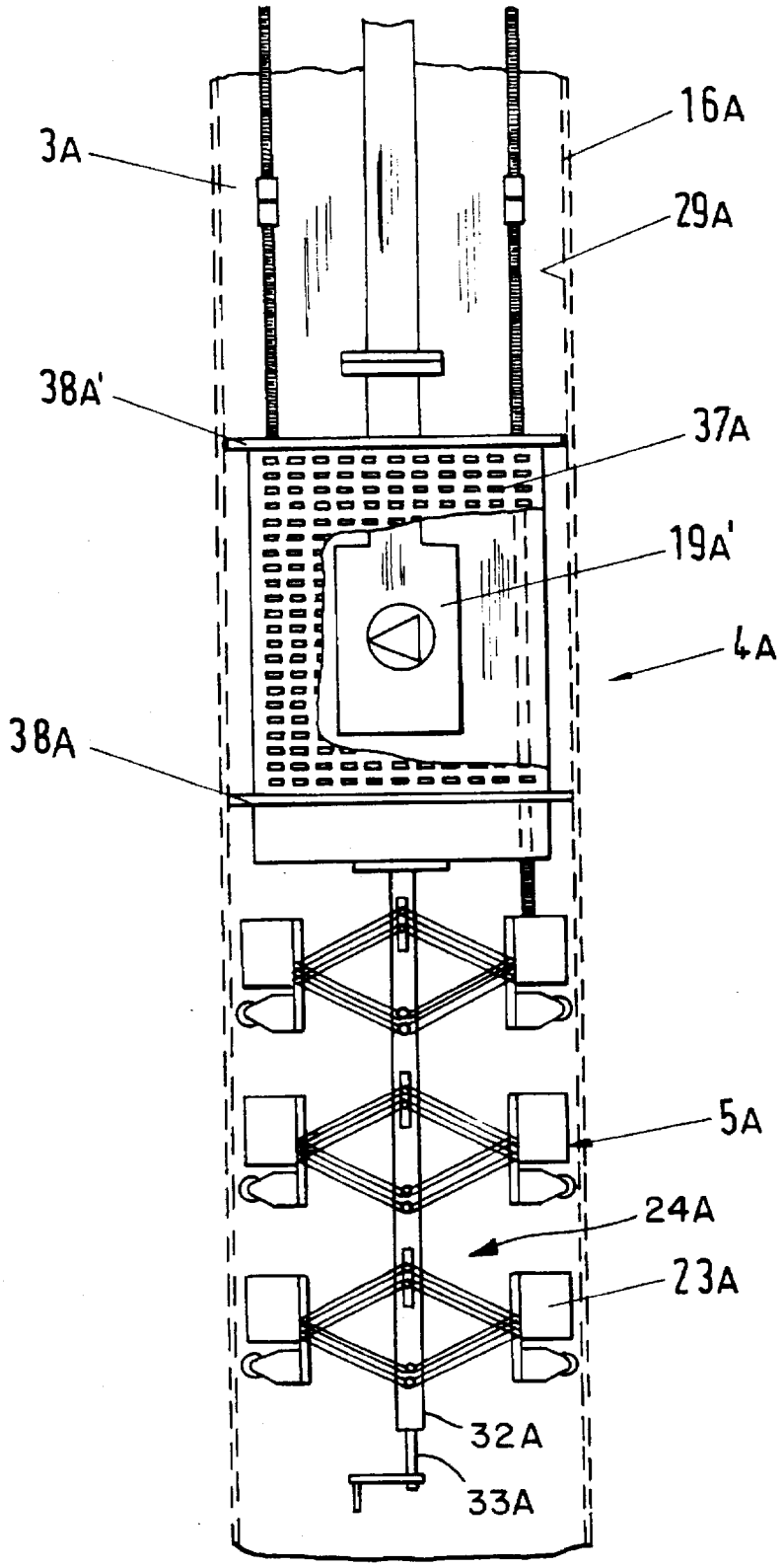
FIG. 6 is a view similar to that of FIG. 5, but showing an alternative embodiment of a pump unit.

FIG. 6 shows an alternative embodiment of a cleaning unit 4A according to the invention, wherein components in common with the above described embodiment bear the same reference numbers with the additional reference suffix "A". The cleaning unit 4A is essentially identical to the above described embodiment regarding the arrangement of ultrasonic generator units 5A. The only differences between the embodiments relate to the dirty water pump 19A' and to the manner of operation. The present dirty water pump 19A' comprises suction inlets 37A along its entire length. These suction inlets 37A are located between a bottom seal element 38A and a top seal element 38A', which respectively substantially seal the dirty water pump 19A' or especially its suction inlets 37A relative to the inner surface 29A of the well casing 16A. Therefore, the dirty water pump 19A' can essentially only suck dirty water out of the portion of the well bore 3A that is located and substantially sealed between the two seal members 38A and 38A'.

The position and arrangement of the suction inlets 37A and the seals 38A and 38A' at the lower and upper ends of the dirty water pump 19A' consequently require that the cleaning unit 4A is moved downward by one working step unit distance immediately after the ultrasonic treatment, and not only after a step of sucking out the dirty water as in the previously described embodiment according to FIG. 5. Similarly to the previous embodiment, the portion of the well bore 3A that is to be cleaned is first ultrasonically irradiated with the ultrasonic generator units 5A. Thereafter, however, in contrast to the previous embodiment, the dirty water pump 19A' is not immediately operated, but rather is first moved downward so that it is located at the portion of the well bore that has been ultrasonically irradiated, and thereupon the pump 19A' is operated to suck out the dirty water. In this context, it should be understood that the suction inlets 37A preferably extend over the same sized surface and axial length of the respective portion of the well bore 3A as the ultrasonic generator unit 5A covers with its ultrasonic transducers 23A.

It should also be understood that once a first section of the well has been ultrasonically treated and the cleaning unit 4A has been moved onto a second successive section of the well, the pump 19A' can remove the contaminants in the dirty water from the first treated section while the ultrasonic generator unit 5A is ultrasonically treating the second section. Thereafter, the cleaning unit 4A is moved once again so that the pump 19A' sucks the dirty water out of the second section while the ultrasonic generator unit 5A is ultrasonically treating the third section of the well, and so forth. The cleaning unit 4A can even be moved in a controlled continuous manner, rather than a stepwise manner.

Figure 7:
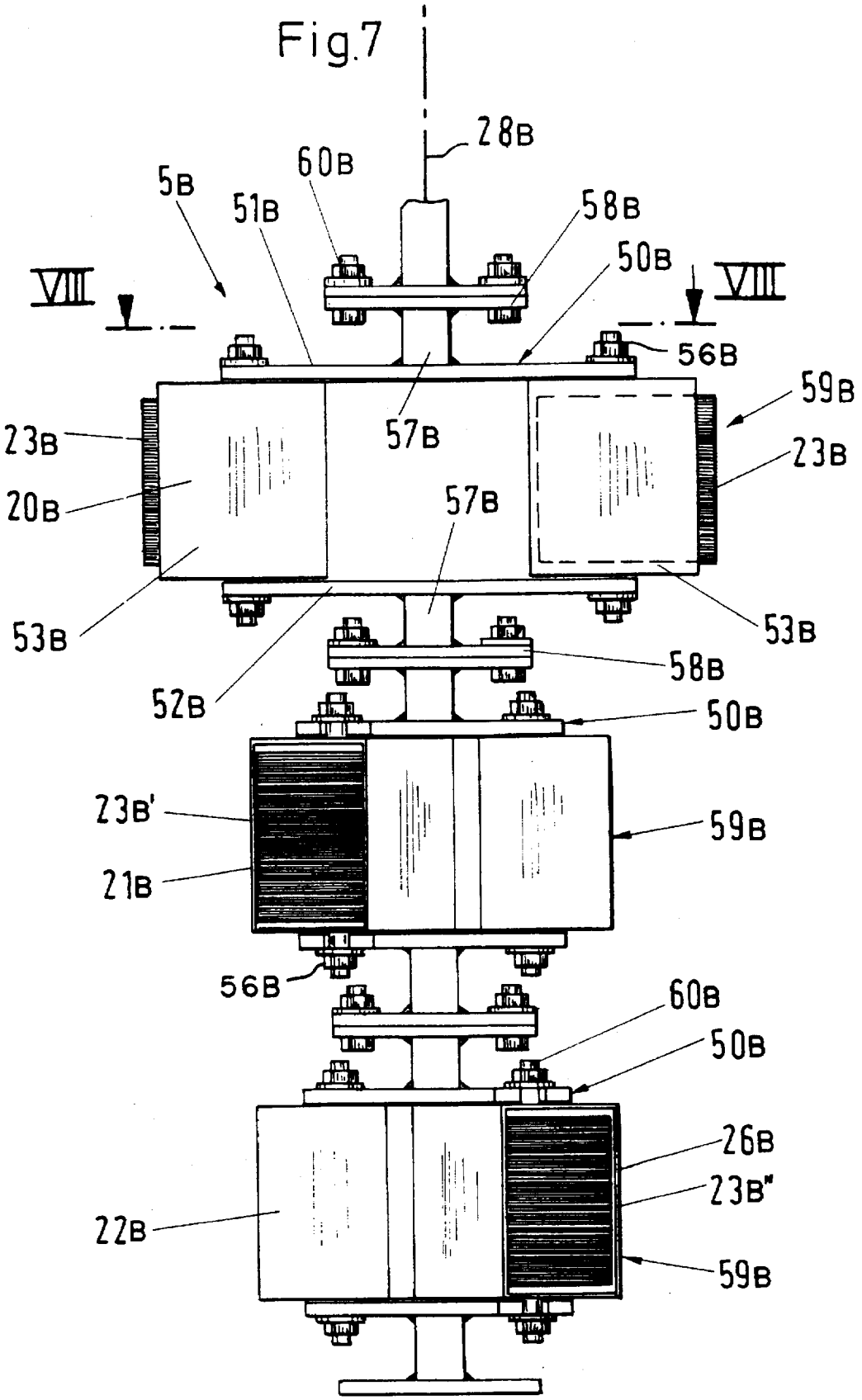
FIG. 7 is an enlarged detailed side view of another example embodiment of an ultrasonic transducer unit according to the invention.
Figure 8:
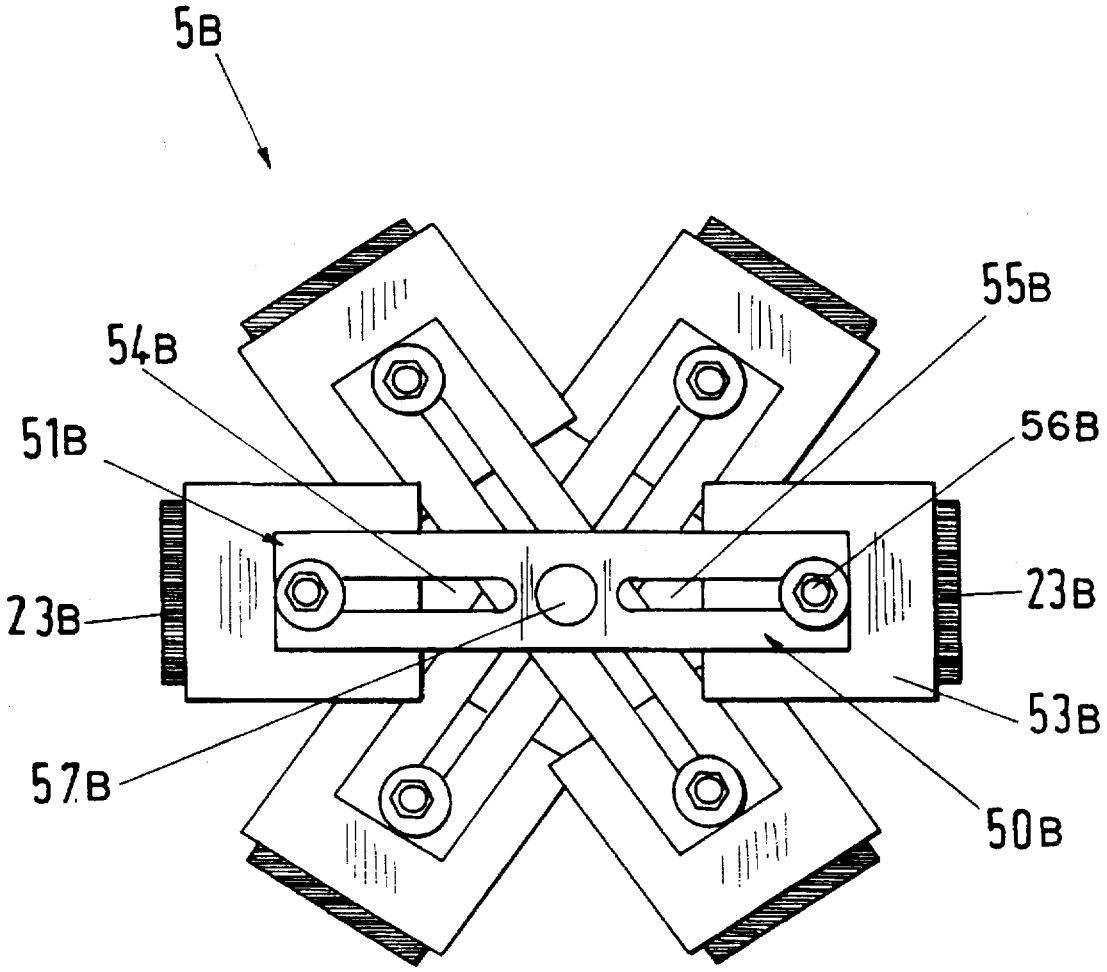
FIG. 8 is a top view of the ultrasonic transducer unit of FIG. 7, as seen in the direction of section line VIII—VIII in FIG. 7.

A further example embodiment of an ultrasonic generator unit 5B is shown in FIGS. 7 and 8, wherein components common to the above described embodiments are identified with the same reference numbers followed by the suffix "B". The ultrasonic generator unit 5B has a different type of adjustment mechanism as compared to the above described mechanism 24. The adjustment mechanism of the ultrasonic generator unit 5B is in the form of adjustable mount arrangements 50B, on which the ultrasonic transducers 23B, 23B', and 23B" are adjustably mounted so that they can be adjusted in the radial direction to the respective diameter of the well. Each adjustable mount arrangement 50B includes two arms 51B and 52B that extend radially and parallel to one another. In the present example embodiment, the arms 51B and 52B are upper and lower double arms that each extend radially outwardly respectively from the well axis 28B an equal radial distance. The respective ultrasonic transducers 23B, 23B' and 23B" are arranged between the respective pairs of arms 51B and 52B at three respective planes 20B, 21B and 22B. The ultrasonic transducers are suitably arranged in housings 53B which in turn directly connect the ultrasonic transducers to the arms 51B and 52B.

In order to allow the radial position and orientation of the ultrasonic transducers 23B, 23B' and 23B" to be adjusted in a continuous or stepless manner, elongated or slotted holes 54B and 55B are provided in the arms 51B and 52B as shown in FIG. 8. Suitable securing elements 56B, such as threaded bolts and corresponding nuts for example, extend through the elongated holes 54B and 55B to secure the ultrasonic transducers 23B, 23B', and 23B" and their respective housings 53B between and at the desired radial position along the two arms 51B and 52B of the respective adjustable mount arrangement 50B.

In the present embodiment, respective pairs of ultrasonic transducers 23B or 23B' or 23B" and the two associated arms 51B and 52B together form respective structural units or modules 59B, which further include connector elements comprising intermediate stub members 57B and connection flanges 58B. A plurality of modules 59B are connected together at their respective mating or aligning connection flanges 58B by securing members 60B, such as bolts and nuts, to form the ultrasonic generator unit 5B.

As shown in FIG. 4 with respect to the above described embodiment of FIGS. 3 and 4, and as shown in FIG. 8 with respect to the present embodiment, the ultrasonic transducers 23, 23A, 23B are generally arranged in a star-shaped pattern, i.e. in a spoke pattern about a central axis. However, preferably only two ultrasonic transducers 23, 23A, 23B are arranged at radially opposite positions in each of the radially extending planes 20B, 21B, and 22B, as shown in FIG. 7 for the present embodiment for example. In other words, each ultrasonic generator module 59B includes two ultrasonic transducers 23B, 23B' or 23B", but an axial end view of the entire ultrasonic generator unit 5B exhibits the star- or spoke-shaped pattern. This results because the three modules 59B, i.e. the paired ultrasonic transducers 23B, 23B', 23B" together with their corresponding adjustable mount arrangements 50B, are each rotated relative to the adjacent module 59B, so that none of the ultrasonic transducers are axially aligned with each other in the lengthwise direction of the well. For example, in the embodiment of FIGS. 7 and 8 including three ultrasonic transducer modules 59B, each module is rotated by 60° relative to the adjacent module so that the axially viewed star pattern of FIG. 8 results.

The surface area of the well casing 16 and the surrounding gravel layer 18 that is impinged upon and treated by the ultrasonic waves emitted by each ultrasonic transducer is noticeably larger than the ultrasonic emitting surface 26B of that transducer. The above described arrangement of transducers achieves a substantially even or uniform overall ultrasonic treatment, and ensures that an over-application or over-treatment with the ultrasonic waves does not occur.

As described above, a connector member comprising an intermediate stub member 57B and a connection flange 58B is connected to each of the arms 51B and 52B. For space reasons, i.e. to allow the most compact arrangement, only the radially adjustable ultrasonic transducers 23B, 23B', and 23B" and their respective housings 53B are arranged in the space between each pair of arms 51B and 52B. For this reason, it is possible to position the ultrasonic transducers, or rather their housings 53B, directly back-to-back against one another between the respective pairs of arms 51B and 52B in order to adjust the cleaning unit for cleaning a well bore having the smallest possible diameter. This can only be achieved when respectively only two ultrasonic transducers 23B, 23B' or 23B" are arranged in each plane 20B, 21B or 22B diametrically opposite one another, and furthermore the planes 20B, 21B and 22B are axially spaced from one another sufficiently to allow clearance between axially adjacent transducers.

Although the invention has been described with reference to specific example embodiments, it will be appreciated that it is intended to cover all modifications and equivalents within the scope of the appended claims.

What is claimed is:

1. A method of cleaning a well by ultrasound using an apparatus comprising an ultrasonic generator unit including at least two magnetostrictive ultrasonic transducers on each of at least one radial plane of said ultrasonic generator unit, wherein each said magnetostrictive ultrasonic transducer has an ultrasonic emitting surface having an output power density in the range from 8 to 12 Watts/cm$^2$ of said emitting surface, said method comprising positioning said ultrasonic generator unit in said well, and magnetostrictively generating at least one ultrasonic wave with said magnetostrictive ultrasonic transducers.

2. The method of claim 1, wherein said positioning is carried out so that said at least one ultrasonic wave is directed substantially perpendicularly at a wall of said well, and said generating is carried out using a resonant frequency and a longitudinal oscillation of said magnetostrictive ultrasonic transducers.

3. The method of claim 1, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and thereafter further comprising vertically moving said cleaning unit a vertical distance in said well and then operating said water pump to suck dirty water from said first portion of said well.

4. The method of claim 1, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and further comprising operating said water pump to suck dirty water from said first portion of said well without moving said cleaning unit between said positioning and generating steps and said step of operating said water pump, and thereafter further comprising vertically moving said cleaning unit a vertical distance in said well.

5. The method of claim 1, wherein said generating step comprises generating said at least one ultrasonic wave with said ultrasonic transducers with a power density in the range from 8 to 12 Watts/cm$^2$ of surface area of said ultrasonic emitting surface of said transducers.

6. The method of claim 5, wherein said positioning is carried out so that said at least one ultrasonic wave is directed substantially perpendicularly at a wall of said well, and said generating is carried out using a resonant frequency and a longitudinal oscillation of said ultrasonic transducers.

7. The method of claim 5, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and thereafter further comprising vertically moving said cleaning unit a vertical distance in said well and then operating said water pump to suck dirty water from said first portion of said well.

8. The method of claim 5, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and further comprising operating said water pump to suck dirty water from said first portion of said well without moving said cleaning unit between said positioning and generating steps and said step of operating said water pump, and thereafter further comprising vertically moving said cleaning unit a vertical distance in said well.

9. The method of claim 1, wherein said generating step comprises generating said at least one ultrasonic wave with said ultrasonic transducers at a frequency in the range from 18 to 25 kHz.

10. The method of claim 9, wherein said at least one ultrasonic wave is generated at a frequency of about 20 kHz.

11. The method of claim 9, wherein said positioning is carried out so that said at least one ultrasonic wave is directed substantially perpendicularly at a wall of said well, and said generating is carried out using a resonant frequency and a longitudinal oscillation of said ultrasonic transducers.

12. The method of claim 9, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and thereafter further comprising vertically moving said cleaning unit a vertical distance in said well and then operating said water pump to suck dirty water from said first portion of said well.

13. The method of claim 9, wherein said apparatus further comprises a cleaning unit including a water pump and said ultrasonic generator unit, wherein said positioning and generating steps respectively comprise positioning said cleaning unit in said well and generating said at least one ultrasonic wave to ultrasonically treat a first portion of said well, and further comprising operating said water pump to suck dirty water from said first portion of said well without moving said cleaning unit between said positioning and generating steps and said step of operating said water pump, and thereafter further comprising vertically moving said cleaning unit a vertical distance in said well.

14. An apparatus for cleaning a well using ultrasound comprising an ultrasonic generator unit including at least two magnetostrictive ultrasonic transducers on each of at least one radial plane of said ultrasonic generator unit, wherein each said magnetostrictive ultrasonic transducer has an ultrasonic emitting surface having an output power density in the range from 8 to 12 Watts/cm$^2$ of said emitting surface.

15. The apparatus of claim 14, comprising a total of more than two of said ultrasonic transducers arranged in a spoke pattern about a central axis of said ultrasonic generator unit.

16. The apparatus of claim 14, wherein said ultrasonic transducers are arranged on a plurality of said radial planes.

17. The apparatus of claim 14, including exactly two of said ultrasonic transducers on each said radial plane, wherein said two ultrasonic transducers are arranged diametrically opposite one another on said radial plane.

18. The apparatus of claim 14, wherein said ultrasonic generator unit further comprises an adjustment mechanism, wherein said ultrasonic transducers are mounted on said adjustment mechanism, and wherein said adjustment mechanism is adapted to be adjustable to adjust respective positions of said ultrasonic transducers perpendicularly to a central axis of said ultrasonic generator unit.

19. The apparatus of claim 18, wherein said adjustment mechanism comprises a pair of pivotable parallel links in an adjustable parallelogram linkage.

20. The apparatus of claim 18, wherein said adjustment mechanism comprises an adjustable mount arrangement including a pair of fixed, radially extending parallel mounting arms.

21. The apparatus of claim 20, wherein said mounting arms have elongated holes therein.

22. The apparatus of claim 20, wherein said ultrasonic transducers are respectively connected to and mounted between said mounting arms.

23. The apparatus of claim 20, further comprising connector elements attached to said mounting arms, wherein said connector elements, said mounting arms, and said transducers together form an ultrasonic generator module that is adapted to be connected to another ultrasonic generator module by said connector elements.

24. The apparatus of claim 14, further comprising a pump suction housing, a water pump arranged in said pump suction housing, and a seal ring encircling said pump suction housing and adapted to form a seal between said pump suction housing and a wall of the well, wherein said ultrasonic generator unit is connected to said pump suction housing in vertical axial alignment therewith, and said pump suction housing has suction water inlet openings passing thereinto located only on a side of said seal ring toward said ultrasonic generator unit.

25. The apparatus of claim 14, further comprising a pump suction housing, a water pump arranged in said pump suction housing, and two seal rings arranged vertically spaced apart from one another so as to respectively encircle said pump suction housing and respectively adapted to form a seal between said pump suction housing and a wall of the well, wherein said ultrasonic generator unit is connected to said pump suction housing in vertical axial alignment therewith, and said pump suction housing has suction water inlet openings passing thereinto located only between said two seal rings.

* * * * *